United States Patent [19]

Silvestri, Jr.

[11] 4,297,848

[45] Nov. 3, 1981

[54] METHOD OF OPTIMIZING THE EFFICIENCY OF A STEAM TURBINE POWER PLANT

[75] Inventor: George J. Silvestri, Jr., Upper Chichester, Pa.

[73] Assignee: Westinghouse Electric Corp., Pittsburgh, Pa.

[21] Appl. No.: 97,770

[22] Filed: Nov. 27, 1979

[51] Int. Cl.[3] ..... F01K 13/02

[52] U.S. Cl. ..... 60/660; 60/663; 60/667

[58] Field of Search ..... 60/660, 663, 664, 665, 60/667; 290/52

[56] References Cited

U.S. PATENT DOCUMENTS

| | | | |
|---|---|---|---|
| 3,948,054 | 4/1976 | Lardi et al. | 60/660 |
| 4,005,581 | 2/1977 | Aanstad | 60/660 |
| 4,178,762 | 12/1979 | Binstock et al. | 60/667 |
| 4,178,763 | 12/1979 | Stern et al. | 60/660 X |

*Primary Examiner*—Allen M. Ostrager
*Attorney, Agent, or Firm*—W. E. Zitelli

[57] ABSTRACT

A method is disclosed for improving the operational efficiency of a steam turbine power plant by governing the adjustment of the throttle steam pressure of a steam turbine at a desired power plant output demand value. In the preferred embodiment, the impulse chamber pressure of a high pressure section of the steam turbine is measured as a representation of the steam flow through the steam turbine. At times during the operation of the plant at the desired output demand value, the throttle pressure is perturbed. The impulse chamber pressure is measured before and after the perturbations of the throttle pressure. Because changing thermodynamic conditions may occur possibly as a result of the perturbations and provide an erroneous representation of the steam flow through the turbine, the impulse chamber pressure measurements are compensated for determined measurable thermodynamic conditions in the steam turbine. A compensated change in impulse chamber pressure measurement in a decreasing direction as a result of the direction of perturbation of the steam throttle pressure may indicate that further adjustment in the same direction is beneficial in minimizing the steam flow through the steam turbine at the desired plant output demand value. The throttle steam pressure adjustment may be continually perturbed in the same direction until the compensated change in impulse chamber pressure before and after measurements falls below a predetermined value, whereby the steam flow is considered substantially at a minimum for the desired plant output demand value.

12 Claims, 6 Drawing Figures

METHOD OF OPTIMIZING THE EFFICIENCY OF A STEAM TURBINE POWER PLANT

CROSS REFERENCE TO RELATED COPENDING APPLICATIONS

Ser. No. 889,770; entitled "System for Minimizing Valve Throttling Loses In a Steam Turbine Power Plant"; filed by L. P. Stern, et al. on Mar. 24, 1978, now U.S. Pat. No. 4,178,763;

Ser. No. 889,764; entitled "Efficient Valve Point Controller for Use In a Steam Turbine Power Plant"; filed by M. H. Binstock, et al. on Mar. 24, 1978, now U.S. Pat. No. 4,178,762;

both applications being assigned to the same assignee as the present application and being referenced to herein for providing a description of systems which presently govern the throttle pressure adjustment for enhancing steam turbine power plant efficiency.

BACKGROUND OF THE INVENTION

The present invention relates to methods for enhancing steam turbine power plant efficiencies, and more particularly, to a method which governs the adjustment of the throttle pressure of a steam turbine to optimize the efficiency thereof with respect to the thermodynamic operating conditions at desired loading conditions of the power plant.

During the operation of a steam turbine in a power plant facility, the steam pressure drops existing across the modulating steam admission valves of the steam turbine cause compositely throttling losses in efficiency of the steam turbine which eventually renders a reduction in the effective energy produced by the power plant. Control systems, like the ones disclosed in the copending U.S. Patent application Nos. 889,770 and 889,764 (referenced hereabove), for example, have been proposed to minimize the valve throttling losses by governing the adjustment of the throttle pressure of the turbine in accordance with a set of predetermined optimum valve position characterizations which are generally preprogrammed therein. However, the optimum valve position points do not necessarily provide under all conditions, the optimum thermodynamic operating points of the steam turbine which, in most cases, cannot be determined a priori.

For example, thermodynamic parameters, like pressure and temperature, of the steam turbine of a power plant have a tendency to vary, under a substantially fixed electrical loading state, in time, as a result of changing environmental factors or the like. As a result, the optimum valve position points which may have been predetermined for one set of thermodynamic conditions may not optimize the efficiency of the steam turbine thermodynamically at substantial steam temperature and pressure variations from the one set. Apparently then, optimizing turbine efficiency with respect to throttling losses does not necessarily additionally guarantee an optimum in thermodynamic operation of the steam turbine. It appears that it may also be necessary, for the purposes of optimizing the efficiency of the steam turbine thermodynamically, to compensate for the variations in the steam temperature and pressure of the steam turbine during the normal operation thereof. Accordingly, a method capable of compensating for these changing thermodynamic conditions appears most desirable with regard to further improving the energy production efficiency of the steam turbine power plant.

Along the same lines, it is well known that for a given turbine loading condition, the maximum turbine efficiency is actually reached with minimum steam flow through the turbine. It seems to follow that measuring the steam flow through the turbine may be a step in the direction of establishing when a steam turbine is being optimally operated at a desired plant loading condition. However, known steam flow measuring devices do not appear to offer the sensitivity required for efficiency control purposes probably because a majority of these instruments use a differential steam pressure measurement in their derivation of steam flow. In an experiment with one of these known type flow measuring instruments, a deviation of approximately 0.3% in flow values are measured for a constant steam flow. Apparently, if steam flow is to be the turbine parameter which reflects efficiency under varying thermodynamic conditions, then a method, other than direct measurement, is required to provide a more accurate and precise measurement thereof.

SUMMARY OF THE INVENTION

In accordance with the broad principles of the present invention, a method for improving the operational efficiency of a steam turbine power plant at a desired power demand output value is disclosed. A predetermined turbine parameter which is representative of the steam flow through the steam turbine is measured at the desired power demand output value. The measured value is compensated in accordance with varying thermodynamic conditions of the steam turbine during the operation thereof at the desired power demand output value. An adjustment of the steam pressure at the throttle of the steam turbine is governed based on selected compensated measured values of the turbine parameter to improve the operational efficiency of the steam turbine.

More specifically, a reference value of the measured values of the predetermined turbine parameter, preferably the impulse chamber pressure of the high pressure turbine section of the steam turbine, is established. Thereafter, the throttle steam pressure is perturbed and a value of the compensated values of the predetermined turbine parameter which are measured subsequent the perturbation is established. A level at which to govern the adjustment of the throttle steam pressure at the desired power demand level is next determined based on a function of the established reference and compensated measurement values of the predetermined turbine parameter.

For the case in which impulse chamber pressure is the measured turbine parameter, the compensation thereof may be compositely performed in accordance with the following relationship:

$$P_{IC}=(P_I\sqrt{P_{TR}V_R/P_TV})(KW/KW_R)(1-\Delta)$$

wherein $P_{IC}$ is the compensated value of one selected measurement value of impulse chamber pressure, $P_I$; V and $V_R$ are derived specific volume values for steam at the turbine throttle associated with the one selected measurement value, $P_I$, and a previously selected measurement value, $P_{IR}$, respectively; $P_T$ and $P_{TR}$ are the throttle steam pressure measurement values associated with $P_I$ and $P_{IR}$, respectively; KW and $KW_R$ are power output measurement values of the plant associated with $P_I$ and $P_{IR}$, respectively; and wherein the term $\Delta$ has the expanded relationship which includes:

$$\Delta=(T_{TR}-T_T)K_1+(T_{RR}-T_R)K_2,$$

wherein $T_T$ and $T_{TR}$ are measured steam temperatures at the turbine throttle associated with $P_I$ and $P_{IR}$, respectively; wherein $T_R$ and $T_{RR}$ are measured steam temperatures at a reheat section of the steam turbine associated with $P_I$ and $P_{IR}$, respectively; and $K_1$ and $K_2$ are predetermined constants.

DESCRIPTION OF THE PREFERRED EMBODIMENT

Figure 1:
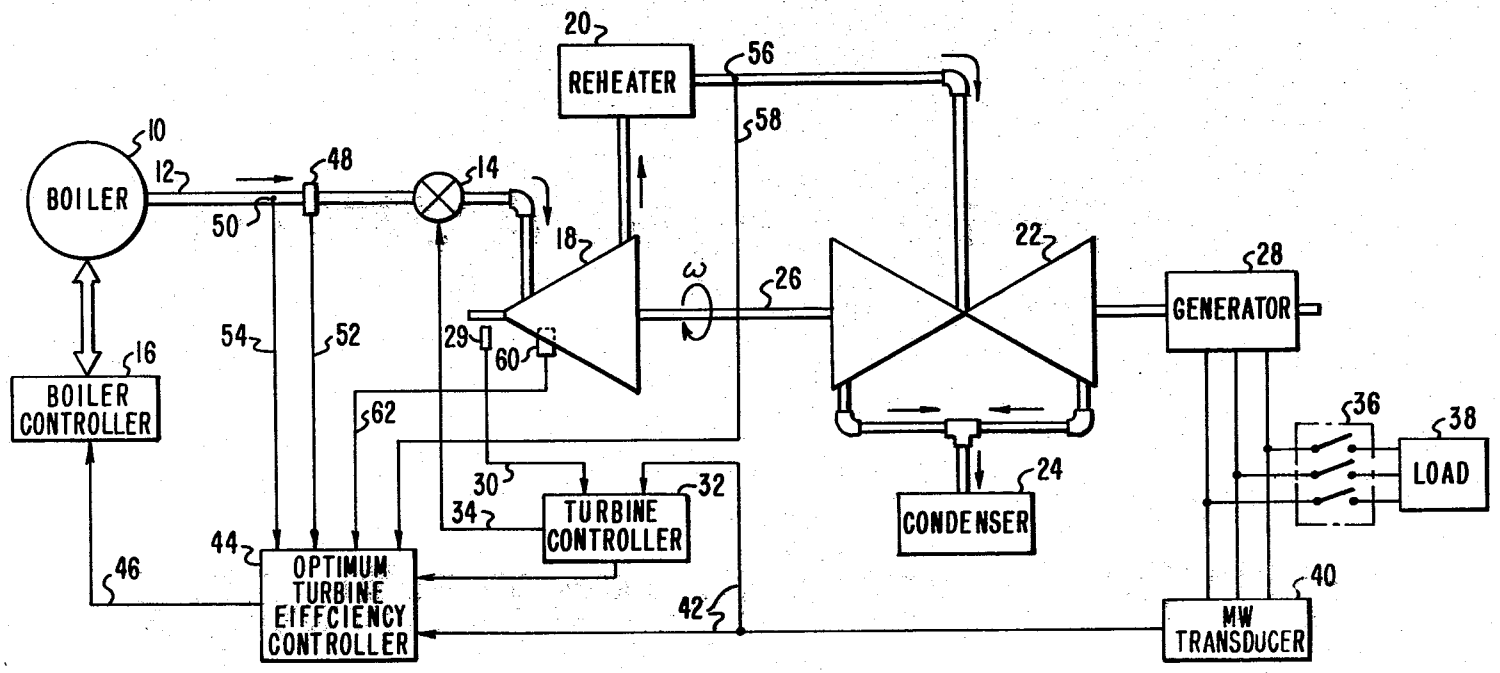
FIG. 1 depicts illustratively a steam turbine power plant suitable for embodying the principles of applicant's method.

In FIG. 1 is depicted a functional block diagram schematic of a typical steam turbine power plant suitable for embodying the principles of the present invention. In the plant of FIG. 1, a conventional boiler 10 which may be of a nuclear fuel or fossil fuel variety produces steam which is conducted through a throttle header 12 to a set of steam admission valves depicted at 14. Associated with the boiler 10, is a conventional boiler controller 16 which is used to control various boiler parameters such as the steam pressure at the throttle 12. More specifically, the steam pressure at the throttle 12 is usually controlled by a set point controller (not shown in FIG. 1) disposed within the boiler controller 16. Such a set point controller arrangement is well known to all those skilled in the pertinent art and therefore, requires no detailed description for the present embodiment. Steam is regulated through a high pressure section 18 of the steam turbine in accordance with the positioning of the steam admission valves 14. Normally, steam exiting the high pressure turbine section 18 is reheated in a conventional reheater section 20 prior to being supplied to at least one lower pressure turbine section shown at 22. Steam exiting the turbine section 22 is conducted into a conventional condenser unit 24.

In most cases, a common shaft 26 mechanically couples the steam turbine sections 18 and 22 to an electrical generator unit 28. As steam expands through the turbine sections 18 and 22, it imparts most of its energy into torque for rotating the shaft 26. During plant startup, the steam conducted through the turbine sections 18 and 22 is regulated to bring the rotating speed of the turbine shaft to the synchronous speed of the line voltage or a subharmonic thereof. Typically, this is accomplished by detecting the speed of the turbine shaft 26 by a conventional speed pickup transducer 29. A signal 30 generated by transducer 29 is representative of the rotating shaft speed and is supplied to a conventional turbine controller 32. The controller 32 in turn governs the positioning of the steam admission valves using signal lines 34 for regulating the steam conducted through the turbine sections 18 and 22 in accordance with a desired speed demand and the measured speed signal 30 supplied to the turbine controller 32.

A typical main breaker unit 36 is disposed between the electrical generator 28 and an electrical load 38 which for the purposes of the present description may be considered a bulk electrical transmission and distribution network. When the turbine controller 32 determines that a synchronization condition exists, the main breaker 36 may be closed to provide electrical energy to the electrical load 38. The actual power output of the plant may be measured by a conventional power measuring transducer 40, like a watt transducer, for example, which is coupled to the electrical power output lines supplying electrical energy to the load 38. A signal which is representative of the actual power output of the power plant is provided to the turbine controller 32 over signal line 42. Once synchronization has taken place, the controller 32 may conventionally regulate the steam admission valves 14 to provide steam to the turbine sections 18 and 22 commensurate with the desired electrical power generation of the power plant.

In accordance with the present invention, an optimum turbine efficiency controller 44 is additionally disposed as part of the steam turbine power plant of FIG. 1. The controller 44 monitors the thermodynamic conditions of the plant at a desired power plant output by measuring various turbine parameters as will be more specifically described herebelow and with the benefit of this information governs the adjustment of the throttle steam pressure utilizing the signal line 46 coupled from the controller 44 to the boiler controller 16. In the present embodiment, the throttle pressure adjustment may be accomplished by altering the set point of the throttle set point controller (not shown) which is generally known to be a part of the boiler controller 16. As may be the case in most set point controllers, the feedback measured parameter, like throttle steam pressure, for example, is rendered substantially close to the set point, the deviation usually being a function of the output/input gain characteristics of the pressure set point controller.

Turbine parameters like throttle steam pressure and temperature are measured respectively by conventional pressure transducer 48 and temperature transducer 50. Signals 52 and 54 generated respectively by the transducers 48 and 50 may be provided to the optimum turbine efficiency controller 44. Another parameter, the turbine reheat steam temperature at the reheater 20 is measured by a conventional temperature transducer 56 which generates a signal 58 may may also be provided to the controller 44 for use thereby. The signal 42 which is generated by the power measuring transducer 40 may be additionally provided to the controller 44. Moreover, an important turbine parameter is one which reflects the steam flow through the turbine sections 18 and 22. For the purposes of the present embodiment, the steam pressure at the impulse chamber of the high pressure turbine section 18 is suitably chosen for that purpose. A conventional pressure transducer 60 is disposed at the impulse chamber section for generating and supplying a signal 62, which is representative of the steam pressure at the impulse chamber, to the controller 44.

Figure 2:
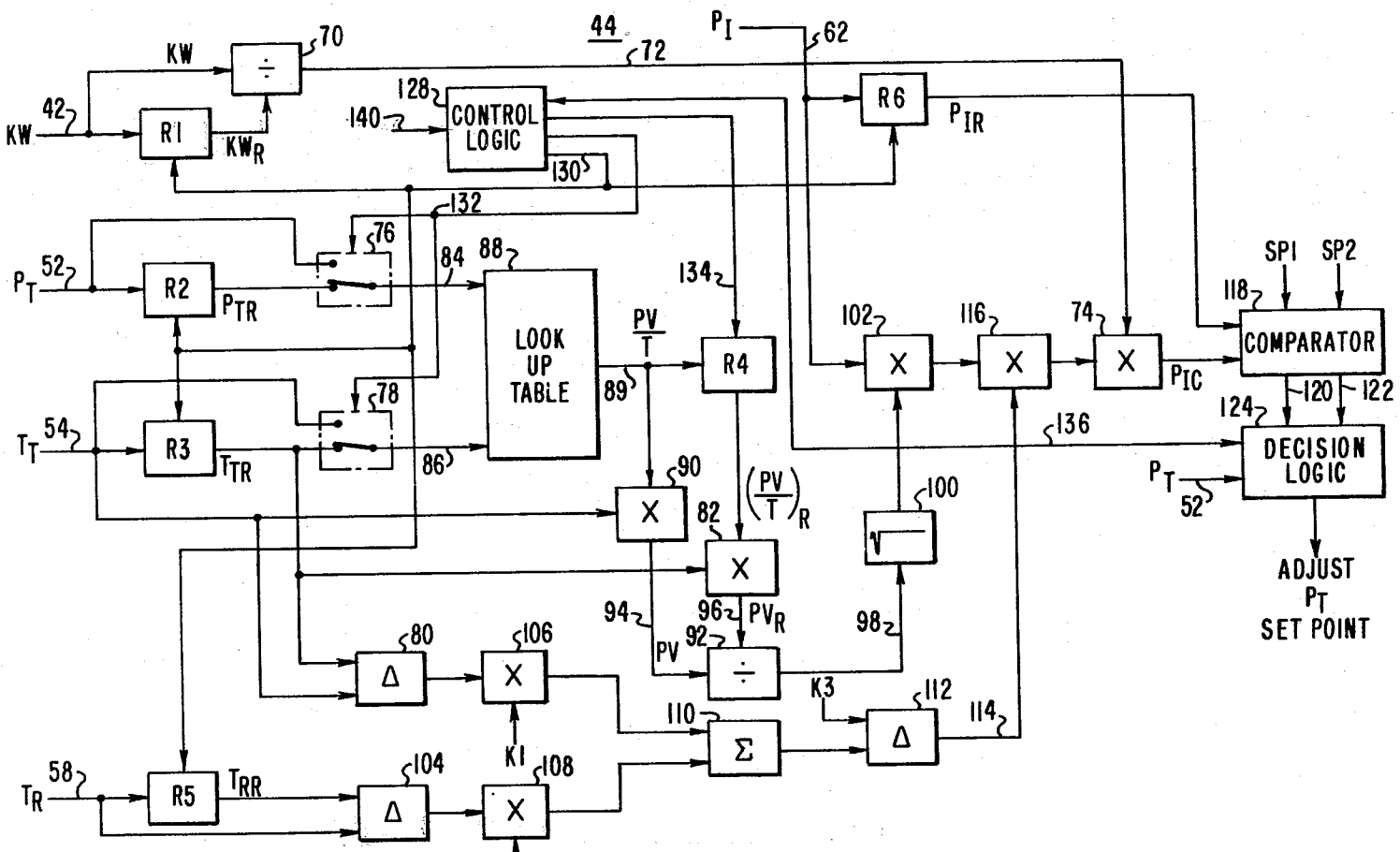
FIG. 2 is a schematic block diagram of an optimum turbine efficiency controller suitable for use in the embodiment of FIG. 1.

One embodiment of the turbine efficiency controller 44 sufficient for describing the operation of the controller 44 in more specific detail is shown in FIG. 2. In the controller 44, the plant power output measurement over signal line 42, denoted as KW, may be coupled to a storage register R1. The output of the storage register R1, denoted as $KW_R$, may be coupled along with the signal 42 to a conventional divider element 70, and the quotient result may be coupled over a signal line 72 to a conventional multiplier unit 74. The steam pressure and temperature transducer signals 52 and 54, denoted as $P_T$ and $T_T$, respectively, may be coupled to the input of storage registers R2 and R3, respectively. In addition, the signal lines 52 and 54 may also be coupled to one throw position of single-pole-double-throw functional switches 76 and 78, respectively. The outputs of the registers R2 and R3, denoted as $P_{TR}$ and $T_{TR}$, respectively, may be coupled to the other throw position of the single-pole-double-throw functional switches 76 and 78, respectively. The signal $T_{TR}$ may be additionally coupled to one input of a conventional subtractor unit 80 and one input of a conventional multiplier arithmetic unit 82. Signal lines 84 and 86 may be used respectively to couple the pole positions of the switches 76 and 78 to inputs of a look up-table denoted at 88. The look-up-table 88 may be preprogrammed to characterize the equation found below.

$$RZ=PV/T \quad (1)$$

Figure 3:
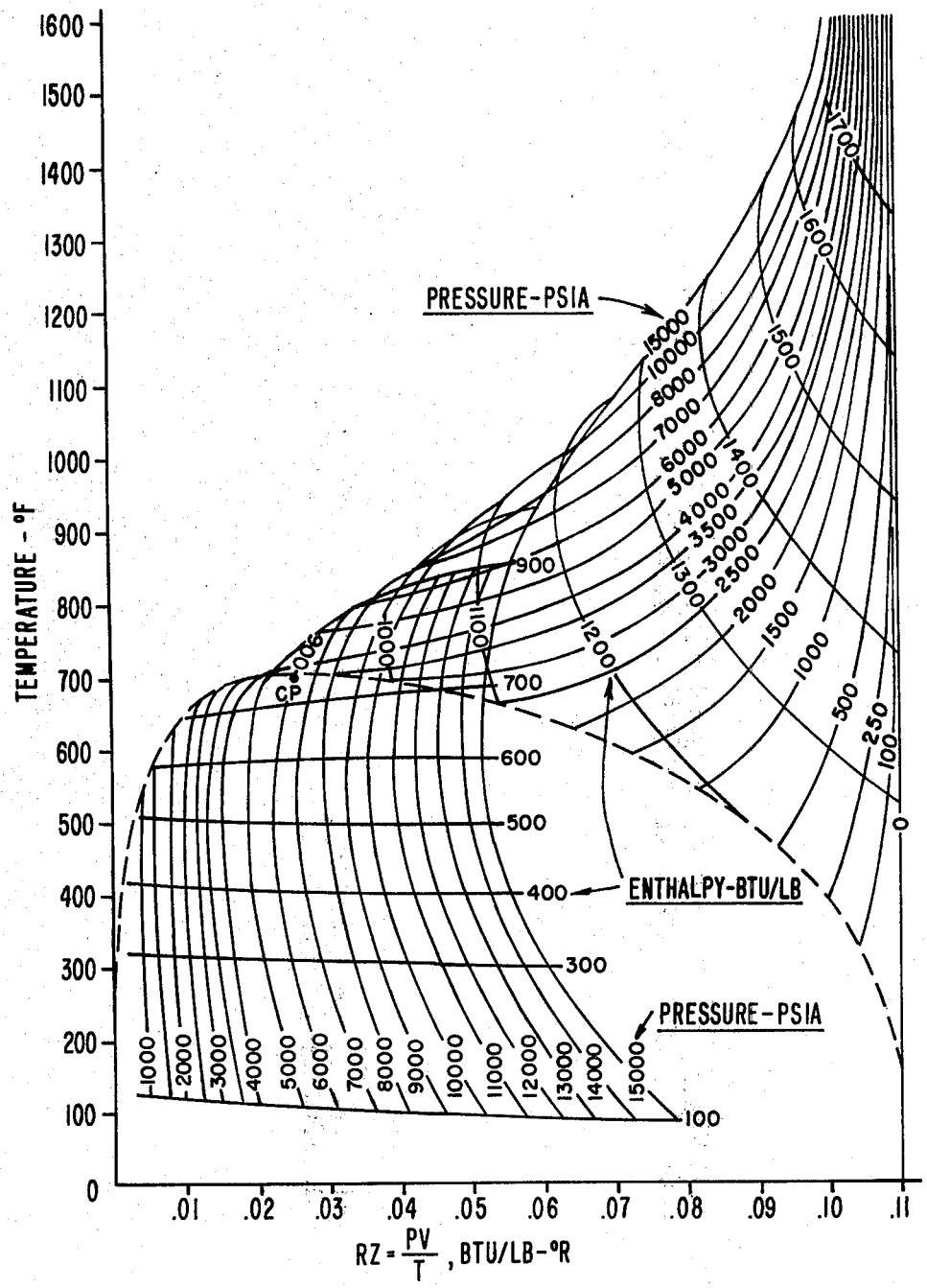
FIG. 3 is a graph which typifies a characteristic steam relationship for programming the look-up-table found in the embodiment of FIG. 2.

The equation (1) shown above is a well known equation found in most sets of steam tables. An example of a graph of equation (1) used for the purposes of programming the look-up-table 88 is shown in FIG. 3. Using the graph of FIG. 3, for example, given any set of pressure and temperature values, the value of RZ or more particularly, PV/T may be extrapolated from the preprogrammed characterized values in the look-up-table 88. In more specific details, the look-up-table 88 may be thought of as a read-only-memory, for example, having the contents of its registers containing the RZ values and the addresses of the registers being the values of the pressure and temperature signals 84 and 86 supplied to the inputs thereof. It is understood that the temperature measurements $T_T$ and $T_{TR}$ may be representative of absolute degrees measurements. It is felt that from the foregoing description of the look up table 88 and with the details of a steam table like that shown in FIG. 3, for example, any one skilled in the art pertinent art of digital or analog programming would be capable of providing a look-up-table for satisfying the functional purposes of the block 88 and that no further description is necessary.

For a better understanding of the equation (1), the term R is the ideal gas constant generally taking upon the value 1544/molecular weight of gas; the term Z is generally a constant of engineering units conversion; the terms P and T are representative of the pressure and temperature of the steam in appropriate engineering units, respectively; and the term V is representative of the specific volume of the steam. In the present embodiment the specific volume represents the volume of one pound of steam at the throttle section 12 of the steam turbine.

An output line 89 of the look-up-table 88 may be coupled to a conventional multiplier unit 90 and to an input of another storage register R4. Another input of the multiplier 90 may be coupled to the throttle temperature signal line 54. A product PV may be effected from the multiplier 90 and supplied to one input of a conventional divider unit 92 over signal line 94. The output signal, denoted as $(PV/T)_R$ of the register R4 may be coupled to another input of the multiplier 82, the output signal $PV_R$ of which may be provided over signal line 96 to another input to the divider unit 92. The output signal line 98 of the divider unit 92 may be provided to a square root function generator 100, the output of which may be supplied to one input of another conventional multiplier unit 102.

It is understood that while the proposed embodiment utilizes a look-up-table to characterize the steam table relationship of equation (1) above, a power plant computer or other preprogrammed device may also be used in place of the look-up-table for deriving the product of pressure x specific volume of steam at the throttle without deviating from the broad principles of applicant's invention.

Returning now to the reheat temperature signal 58 which may be coupled to the input of another storage register R5 and also to one input of another conventional subtractor unit 104. The output of the register R5, denoted as $T_R$, may be provided to the other input of the subtractor unit 104. In a similar manner, the inputs to the subtractor unit 80 may be provided from the signals $T_T$ and $T_{TR}$. The outputs of the subtractor units 80 and 104 may be respectively provided to the multiplier units 106 and 108. In multiplier 106, the input signal may be multiplied by a constant, denoted as K1, and this product may be supplied to a functional summer 110. Likewise, the input signal to multiplier 108 may be multiplied by another constant, denoted as K2, and this product may also be supplied to the summer 110. The resulting summation from 110 may be provided to one input of another subtractor unit 112 wherein it may be subtracted from another constant K3 which may be supplied to the second input thereof. The resulting difference signal may be provided over signal line 114 to one input of another multiplier unit 116. The multiplier units 102, 116, and 74 may be cascadedly coupled to multiply the impulse chamber pressure signal, denoted as $P_I$, over signal line 62 to provide for a compensated impulse chamber pressure signal, denoted as $P_{IC}$. The impulse chamber pressure signal over signal line 62 is also coupled to an input of another storage register R6, the output of which being denoted as $P_{IR}$.

The signals $P_{IC}$ and $P_{IR}$ may be provided to a comparator unit 118 which for the purposes of the present embodiment may be a conventional window comparator having predetermined set points as shown at SP1 and SP2. The results of the comparison in 118 may be provided in digital code over signal lines 120 and 122 to a decision logic functional block 124. The decision logic block 124 may decode the signals 120 and 122 to determine if an adjustment of the throttle pressure set point of the controller 16 is needed and the direction in which the throttle pressure set point should be incrementally governed, for example. For further refinement, the throttle pressure measurement signal over signal line 52 may be provided to the decision logic block 124 as a feedback signal to establish if the throttle pressure has in fact moved the desired incremental quantity and in the specified direction.

A control logic block 128 may also be disposed in the controller 44 for providing timing synchronization for the arithmetic and storage operations performed therein. For example, a timing signal 130 may be provided to the storage registers R1, R2, R3, R5 and R6 for capturing reference values therein of their respective input signals substantially concurrent at prespecified times. Furthermore, an additional timing signal 132 may be provided to each of the single-pole-double-throw functional switches 76 and 78 to provide for proper sequencing in the switching operations thereof. Associated with the same timing mechanism, a timing signal 134 may also be supplied to the storage register R4. Still further, the decision logic circuits of 124 may be monitored and controlled in synchronism with the operation of the other arithmetic and storage transfer devices of 44 in accordance with that preprogrammed in the timing control logic of 128. The timing operations of 128 may be initiated by a start signal over line 140 as is the case in most sequentially operated circuits. The detailed circuitry of the control logic block 128 and decision logic block 124 are considered consistent with conventional design practices. The details of which are in no way any part of the present invention.

Figure 4:
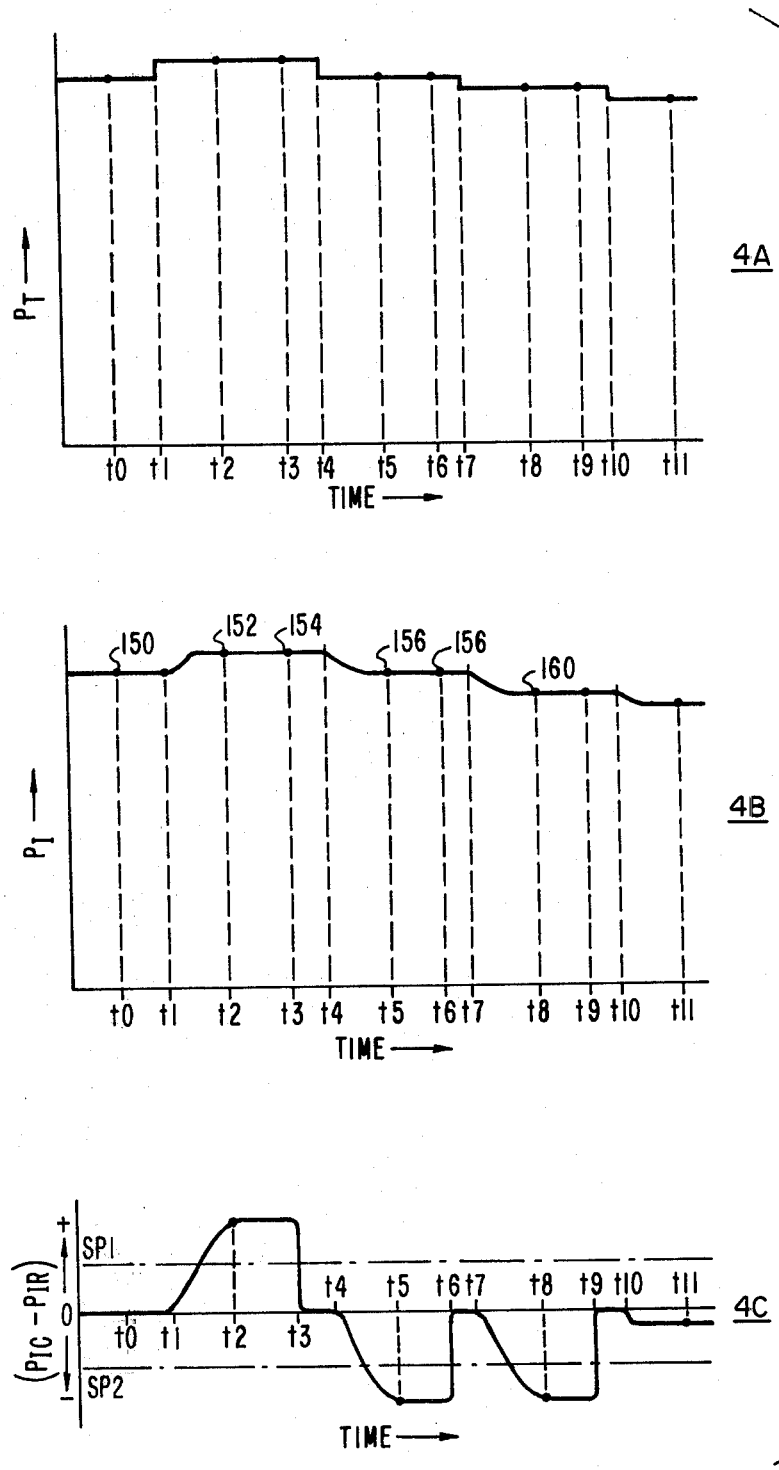
FIGS. 4A, 4B and 4C are time graph waveforms exemplifying the operation of an efficiency controller like the one depicted in FIG. 2.

The waveforms 4A, 4B and 4C of FIG. 4 may be used in connection with FIGS. 1 and 2 to facilitate a better understanding of the operation of the controller 44 with respect to one example. For a typical operation at some initial time, denoted as t0, a start signal is provided over line 140 to the timing control logic block 128. In response to the start signal, the logic block 128 provides a data capture signal to the registers R1, R2, R3, R5, and R6 wherein reference measurement values of the monitored turbine parameters KW, $P_T$, $T_T$, $T_R$, and $P_I$, respectively, may be stored. Thereafter, at a time denoted as t1, the control logic block 128 may command the decision logic block 124 utilizing signal line 136 to govern an incremental perturbation of the throttle pressure by altering the throttle pressure set point, for example, such as that shown in the waveform of 4A. At time t0, the impulse chamber pressure measurement value in waveform 4B is depicted at point 150. In response to the incremental perturbation of the throttle steam pressure at t1 and subsequent to t1, say t2, for example, the impulse chamber pressure takes on a new measurement value as depicted at point 152 in 4B.

Within the time interval t0 and t2, the control logic block 128 may command the switches 76 and 78 using timing signal line 132 to permit the throttle pressure and temperature reference measurement values captured at time t0 to be input over signal lines 84 and 86 to the look-up-table 88. In response to these input signals, the look-up-table 88 may derive a PV/T value in accordance with programmed characteristics of the steam table graph of FIG. 3 used as one example. Thereafter, the timing signal 134 may cause the storage register R4 to capture this derived reference value $(PV/T)_R$ which may be multiplied by the temperature reference value $T_{TR}$ in multiplier 82 to yield a reference value of the steam pressure times the steam specific volume at the throttle for the time t0.

At a selected time, say t2, subsequent the incremental perturbation to the throttle pressure at t1, the functional switches 76 and 78 may be governed by signal line 132 from the control logic block 128 to allow the signal measurements over lines 52 and 54 to be provided to the inputs 84 and 86, respectively, of the look up table 88. A (PV/T) value may be derived for this set of input signals and this derived value may be multiplied by the throttle temperature measurement value $T_T$ at the selected time t2 in multiplier 90 to provide for a steam pressure times specific volume (PV) at the throttle for the selected time t2. The functional relationship of taking the square root of the ratio of $PV_R/PV$ may be accomplished in the blocks 92 and 100, sequentially, the result being provided to multiplier 102 wherein the impulse chamber steam pressure measurement value $P_I$ at time t2 may be compensated for the change in thermodynamic conditions at the steam throttle of the steam turbine.

In another aspect of the present invention, the impulse chamber steam pressure measurement $P_I$ at 62 may also be compensated for changing thermodynamic conditions occurring at the reheater section 20 (See FIG. 1). Typically, the difference in throttle steam temperature measurements between the captured reference measurement $T_{TR}$ and that which occurs in response to the throttle pressure perturbation $T_T$ may be effected in the subtractor unit 80. This difference may be multiplied by a predetermined constant Kl in multiplier unit 106 and provided to the summer 110. The difference between the reference steam temperature measurement at the reheater $T_{RR}$ and the reheater steam temperature measurement responsive to the steam throttle pressure perturbation $T_R$ may be effected in the subtraction unit 104. Similarly, this temperature difference may be multiplied by another predetermined constant K2 in multiplier unit 108, the product also being provided to the summer 110. The summation of these difference temperature measurements multiplied by their respective constants are subtracted from a third predetermined constant K3, which may be the integer one, for example, in the subtractor unit 112, the resulting difference being provided to the multiplier unit 116 over signal line 114 for additionally compensating the impulse chamber pressure measurement $P_I$.

While the steam throttle pressure perturbation occurs at a desired power demand value, there exists the possibility that the actual measured power output of the power plant, denoted as KW, may deviate slightly due to the throttle steam pressure perturbation and because of any insensitivity of the power demand control loop, normally provided in the turbine controller 32. As a result of this possibility, the impulse chamber pressure measurement $P_I$ may also be compensated for deviations in the measured power output of the plant so as not to erroneously reflect a deviation in steam flow through the turbine. For this reason, the captured reference measurement $KW_R$ of the plant power output may be divided into the on-going plant power output measurement KW in the divider 70. The resulting quotient may be provided to multiplier unit 74 over a signal line 72 to further compensate the impulse chamber pressure measurement $P_I$.

In mathematical terms, the composite compensation relationships of the impulse chamber pressure $P_I$ may be designated by the following equation:

$$P_{IC}=\{P_I\sqrt{(PV)_R/PV}\}K \quad (2)$$

where $P_I$ is the real time measurement of the impulse chamber pressure which for the purposes of the present example may be considered as having the value denoted by the point 152 on the waveform 4B, the term $(PV)_R$ designates the derived reference value for the product of the pressure x specific volume of the steam at the throttle of the steam turbine, the term PV is the real time derivation of the product of the pressure x specific volume of the steam at the throttle of the steam turbine and wherein further the term K may be mathematically expressed by the following equation:

$$K=(KW/KW_R)(1-\Delta) \quad (3)$$

where KW and $KW_R$ are the real time and reference measurement values of the measured power output of the plant, respectively; and wherein further the term Δ may be expressed by the following equation:

$$\Delta = \Delta 1 + \Delta 2, \quad (4)$$

wherein $$\Delta 1 = (T_{TR} - T_T)K1, \text{ and } \Delta 2 = (T_{RR} - T_R)K2, \quad (5)$$

wherein $T_{TR}$ and $T_T$ designate the reference and real time measurment values of the throttle steam temperature and $T_{RR}$ and $T_R$ designate the reference and real time measurements of the reheat steam temperature. It is understood if more than one reheater section is utilized within the power plant that additional terms similar to that shown as Δ2 may be additionally added in the formation of the overall Δ term.

The compensated impulse chamber pressure measurement $P_{IC}$ may be compared with the captured reference measurement of impulse chamber pressure $P_{IR}$ in the comparator 118. In the present example, the comparison is performed by subtracting $P_{IR}$ from $P_{IC}$ similar to that which is shown in waveform 4C. At time t2, for example, the control logic block 128 may command the decision logic block 124 over signal lines 136 to monitor the comparator output lines 120 and 122 to record the results of the most recent steam throttle pressure perturbation which proposedly occurred at time t1. Since the compensated impulse chamber pressure measurement is shown to increase responsively in 4C beyond the set point value of SP1 with respect to the reference measurement value $P_{IR}$, the comparator may output a one over signal line 120 and zero over signal line 122, this code being indicative of governing a decrease in the throttle pressure set point over signal line 46 at the next designated perturbation time. The decision logic block 124 may record the comparator result over lines 120 and 132 for execution at a designated subsequent time.

At a time subsequent to t2, say t3, for example as shown in waveforms 4A, 4B and 4C, the control logic unit 128 may command the registers R1, R2, R3, R5, and R6 to capture new reference measurement values of their respective measurement signal inputs. In a like manner as that described hereabove, the functional switches 76 and 78 may be appropriately switched to permit the look-up table 88 to derive a (PV/T) value for the reference pressure temperature measurements of the steam at the throttle of the steam turbine at time t3. This most recently derived $(PV/T)_R$ value may then be captured in the register R4. At a time thereafter, say t4, for example, the decision logic block 124 may govern an incremental perturbation of the throttle pressure in a decreasing direction as depicted in the waveform of FIG. 4A. In response to the throttle pressure perturbation at t4, the impulse chamber pressure is shown to decrease from its reference measurement value at 154 and eventually stabilize to a new value 156 at a later time t5 as shown waveform 4B. The impulse chamber steam pressure measurement value $P_I$ may be compensated in a similar manner as that described above in connection with the embodiment of FIG. 2. The comparison of this most recent compensated impulse chamber pressure measurement value, say at t5, for example, reflects a decrease beyond the set point value SP2 with respect to the impulse chamber pressure reference measurement value captured at time t3 (see waveform 4C). In response to the condition at t5, the comparator 118 may output a one over signal line 122 and a zero over signal line 120 which is a digital code indication that at the next designated time the throttle pressure should be perturbed incrementally in a decreasing direction. These comparator results may be again recorded by commands over signal line 136 by the decision logic block 124.

Later on, at a new time say t6, for example, the storage registers R1, R2, R3, R5 and R6 may be once more commanded to capture new reference measurement of their respective measurement signal input. Thereafter, at say t7, the decision logic block 124 governs an incremental perturbation of the throttle pressure in a decreasing direction as shown in waveform 4A. Likewise, the impulse chamber pressure measurement once more decreases from its reference measurement value at time t6 shown at 158 to a new value designated on the waveform 4B at 160 at a subsequent time t8. The compensated value $P_{IC}$ of the real time impulse chamber measurement signal $P_I$ may be subtracted from the reference measurement value $P_{IR}$ in the comparator 118 resulting in a difference which is outside of the window designated by the predetermined set point values SP1 and SP2 below the value of SP2 as shown in waveform 4C at t8. The comparator 118 may again respond by outputting a one over signal line 122 and a zero over signal line 120 which may inturn be recorded by the decision logic block 124 and used to govern the next adjustment of the throttle steam pressure of the steam turbine.

In the next sequence of operations, occurring at t9, t10 and t11, the reference measurement values captured, the throttle pressure may be governed incrementally in a decreasing direction, and the resulting difference between impulse chamber pressure compensated value and reference values may be monitored. At time t11, the comparator 118 detects that the difference in impulse chamber pressure measurement reference and compensated values are within the window designated by the predetermined set points SP1 and SP2 and responds by outputting zeros over both signal lines 120 and 122 indicating that no further governing of the adjustment of the throttle steam pressure is necessary at this time and that the steam flowing through the turbine is considered at a minimum under the present desired loading conditions of the power plant. In this manner, the operating efficiency of the steam turbine may be enhanced at each of the desired loading conditions.

To activate the controller 44, a new throttle pressure adjustment sequence may be effected on a periodic basis by introducing a signal over line 140 at constant intervals. Another possibility may be to optimize efficiency only at times subsequent to a new demand loading condition. Or, initiating the foregoing throttle pressure adjustment sequence may be left to the judgment of a plant control room operator. It is understood that any of the above or any combination thereof may be used to activate the efficiency controller 44 for the purposes of optimizing the steam flow efficiency at any desired power plant loading condition without deviating from the broad principles of the present invention.

I claim:

1. A method of improving the operational efficiency of a steam turbine power plant at a desired power demand output value comprising the steps of:

measuring a predetermined turbine parameter at said desired power demand output value of said power plant, said predetermined turbine parameter being representative of the steam flow through said steam turbine during the operation thereof;

compensating said measured values of said predetermined turbine parameter in accordance with varying thermodynamic conditions of said steam turbine during the operation thereof at said desired power demand output value; and governing an adjustment of the steam pressure at the throttle of said steam turbine at said desired power demand output level based on selected compensated measured values of said turbine parameter to improve the operational efficiency of said steam turbine.

2. The method in accordance with claim 1 wherein the step of governing the adjustment of the throttle steam pressure includes the steps of:

establishing a reference value of the measured values of the predetermined turbine parameter;

thereafter governing a perturbation of the throttle steam pressure;

selectively establishing a value of the compensated values of the predetermined turbine parameter measured subsequent said perturbation of the throttle steam pressure; and determining a level at which to govern the adjustment of the throttle steam pressure at the desired power demand value based on a function of the established reference and compensated values of the predetermined turbine parameter.

3. The method in accordance with claim 1 wherein the step of governing the adjustment of the throttle steam pressure includes the steps of:

(a) establishing a reference value of the measured values of the predetermined turbine parameter;

(b) thereafter, governing a predetermined incremental perturbation of the throttle steam pressure in a first direction;

(c) establishing a first compensated value of the values of the predetermined turbine parameter measured subsequent the throttle steam pressure perturbation of step (b);

(d) comparing said reference value with said first compensated value;

(e) repeating the steps (a) through (d), if said first compensated value is substantially less than said reference value as determined by said comparison of step (d);

(f) repeating step (a), if said first compensated value is substantially greater than said reference value as determined by said comparison of step (d);

(g) thereafter, governing a predetermined incremental perturbation of the throttle steam pressure in a second direction;

(h) thereafter, establishing a second compensated value of the values of the predetermined turbine parameters measured subsequent the throttle steam pressure perturbation of step (g);

(i) comparing said reference value of step (f) with said established second compensated value; and (j) repeating steps (a) and (g) through (i), if said second compensated value is substantially less than said reference value of step (f) as determined by the comparison of step (i), whereby the throttle steam pressure is adjusted in value in either a first direction or a second direction to minimize the value of the predetermined turbine parameter, which is representative of turbine steam flow, at a desired power demand output value.

4. The method in accordance with claim 1 wherein the step of measuring values of a predetermined turbine parameters includes measuring the steam pressure at the impulse chamber of a high pressure turbine section of the steam turbine, whereby the predetermined turbine parameter of the steam turbine is the impulse chamber steam pressure thereof.

5. The method in accordance with claim 4 wherein the step of compensating the measured values includes the steps of:

deriving the specific volume of steam at the throttle of the steam turbine;

measuring the steam pressure of the throttle of the steam turbine;

selecting impulse chamber steam pressure measurement values; and compensating one selected measured value of impulse chamber steam pressure based on a function of a derived specific volume value and measured throttle steam pressure value associated with said one selected measured value and a derived specific volume value and measured throttle steam pressure value associated with an impulse chamber pressure measurement previously selected.

6. The method in accordance with claim 5 wherein the step of compensating further includes the steps of:

measuring the steam temperature at a steam reheater which reheats steam conducted between the high pressure turbine section and at least one lower pressure turbine section of the steam turbine; and measuring the steam temperature at the throttle of the steam turbine;

additionally compensating the one selected measured value of impulse chamber steam pressure based on a function of measured reheat and throttle steam temperature values associated with the one selected measured value and measured reheat and throttle steam temperature values associated with the impulse chamber pressure measurement previously selected.

7. The method in accordance with claim 6 wherein the step of compensating further includes the steps of:

measuring the power output of the power plant;

additionally compensating the one selected measured value of impulse chamber steam pressure based on a function of a measured power output value associated with the one selected measured value and a measured power output value associated with the impulse chamber pressure measurement previously selected.

8. The method in accordance with claim 7 wherein the step of compensating the one selected impulse chamber pressure measurement is compositely performed in accordance with the following relationship:

$$P_{IC}=(P_I\sqrt{P_{TR}\,V_R/P_T\,V})(KW/KW_R)(1-\Delta);$$

wherein $P_{IC}$ is the compensated value of the one selected measurement value of impulse chamber steam pressure, $P_I$, V and $V_R$ are the derived steam specific volume values associated with the one selected measurement value $P_I$, and a previously selected measurement value, $P_{IR}$, respectively; $P_T$ and $P_{TR}$ are the throttle steam pressure measurement values associated with $P_I$ and $P_{IR}$, respectively; KW and $KW_R$ are the power output measurement values associated with $P_I$ and $P_{IR}$, respectively; and wherein the term $\Delta$ has the expanded relationship which includes:

$\Delta = \Delta 1 + \Delta 2$, where $\Delta 1 = (T_{TR} - T_T) K_1$, and $\Delta 2 = (T_{RR} - T_R) K_2$, $T_T$ and $T_{TR}$ being the measured throttle steam temperature associated with $P_I$ and $P_{IR}$, respectively; $T_R$ and $T_{RR}$ being the measured reheat steam temperatures associated with $P_I$ and $P_{IR}$, respectively, and $K_1$ and $K_2$ being predetermined constants.

9. A method of improving the operational efficiency of a stream turbine power plant at a desired power demand output value comprising the steps of:

measuring the steam temperature and pressure at the throttle of said steam turbine;

measuring the steam pressure at the impulse chamber of a high pressure section of said steam turbine, said impulse chamber steam pressure measurement being representative of the steam flowing through said steam turbine;

measuring the steam temperature at a reheater section which reheats the steam conducted between said high pressure turbine section and at least one lower pressure turbine section of said steam turbine;

establishing reference measurement values of said throttle steam temperature and pressure, said impulse chamber pressure, and said reheat steam temperature;

compensating said impulse chamber steam pressure measurement values based on a function of corresponding measurements of said throttle steam pressure and temperature and said reheat steam temperature, and said corresponding established reference measurement values thereof;

governing incremental perturbations of said throttle steam pressure;

selecting compensated impulse chamber pressure measurement values corresponding to said governed incremental perturbations of said throttle steam pressure; and determining a direction and level at which to govern the perturbations of said throttle steam pressure based on comparisons between a selected compensated impulse chamber pressure value and an established reference impulse chamber pressure value correspondingly associated therewith.

10. The method in accordance with claim 9 wherein the step of determining includes:

minimizing the impule chamber steam pressure by governing the perturbations of the throttle steam pressure in the direction which effects a selected compensated impulse chamber steam pressure substantially lower in value than the established reference measurement value correspondingly associated therewith, whereby the steam flow through the turbine is minimized at said desired power demand output value.

11. The method in accordance with claim 9 wherein the step of compensating includes:

deriving a reference value of the product of the pressure and the specific volume (PV) of steam at the throttle of the steam turbine based on corresponding reference measurement values of throttle steam pressure and temperature;

deriving other values of the product PV of steam at the throttle based on corresponding measurement values of throttle steam pressure and temperature;

selecting a time subsequent the derivation of said reference value of PV;

first multiplying the impule chamber pressure value measured substantially at said selected time by the square-root of the ratio of said derived reference value of PV and a derived other PV value corresponding to said selected time;

computing a first difference between the reference measurement value of the throttle steam temperature and a temperature measurement value thereof corresponding to said selected time and multiplying said first difference by a first constant to effect a first product;

computing a second difference between the reference measurement value of the reheat steam temperature and a temperature measurement value thereof corresponding to said selected time and multiplying said second difference by a second constant to effect a second product;

subtracting a sum of said first and second products from a third constant; and multiplying the result of said first multiplication by the result of said subtraction, thereby providing a compensated impulse chamber pressure measurement value corresponding to said selected time.

12. The method in accordance with claim 10 wherein the step of compensating further includes:

measuring the electrical power output of said power plant at the desired power output value;

establishing a reference value of said electrical power output measurements substantially concurrent with the other reference measurement values;

computing a ratio of an electrical power output measurement value corresponding to the selected time and said established reference value; and multiplying the result of the second multiplication with said computed ratio of electrical power output measurements, thereby further compensating the impulse chamber pressure measurement at the selected time for changes in measured electrical power output.

* * * * *